United States Patent [19]

Commer et al.

[11] Patent Number: 4,502,230

[45] Date of Patent: Mar. 5, 1985

[54] APPARATUS FOR HEATING OR COOLING AND IN PARTICULAR FOR DRYING FINELY PARTICULATE SOLIDS

[75] Inventors: Johann Commer, Duisburg-Beeck; Wulf-Dieter Neuhaus; Volkmar Schmidt, both of Oberhausen, all of Fed. Rep. of Germany

[73] Assignee: Ruhrchemie Aktiengesellschaft, Oberhausen, Fed. Rep. of Germany

[21] Appl. No.: 431,974

[22] Filed: Sep. 30, 1982

[30] Foreign Application Priority Data

Jan. 29, 1982 [DE] Fed. Rep. of Germany ..... 3202954

[51] Int. Cl.[3] ..... F26B 17/10

[52] U.S. Cl. ..... 34/57 E; 165/156; 34/68

[58] Field of Search ..... 34/57 E, 168, 171, 177, 34/178, 68; 165/156

[56] References Cited

U.S. PATENT DOCUMENTS

| | | | |
|---|---|---|---|
| 2,911,730 | 11/1959 | Schaub et al. | 34/57 E |
| 2,983,051 | 5/1961 | Zimmerman et al. | 34/171 |
| 3,068,584 | 12/1962 | Schaube et al. | 34/57 E |
| 4,089,119 | 5/1978 | Heinze | 34/57 E |
| 4,381,819 | 5/1983 | Paolino | 165/156 |

FOREIGN PATENT DOCUMENTS

| | | | |
|---|---|---|---|
| 528407 | 11/1921 | France | 34/171 |

*Primary Examiner*—Larry I. Schwartz

*Attorney, Agent, or Firm*—Sprung Horn Kramer & Woods

[57] ABSTRACT

The invention relates to an apparatus for drying finely particulate solids in a carrier gas stream conducted along a helical path. The apparatus consists of an externally heated and cooled flow tube centrically surrounding a similarly heated and cooled inner body. Guide means helically arranged in succession in the flow direction are situated between the flow tube and inner body, and are formed as aerofoil-like curved or flat plates and are distributed over the whole length of the inner body. These guide means are designed as a self-supporting structure not secured to the inner body.

5 Claims, 4 Drawing Figures

APPARATUS FOR HEATING OR COOLING AND IN PARTICULAR FOR DRYING FINELY PARTICULATE SOLIDS

BACKGROUND OF THE INVENTION

1. Field of the Invention

This invention relates to an apparatus for heating or cooling and in particular for drying finely particulate solids in a carrier gas stream conducted along a helical path. The apparatus comprises an externally heated and cooled flow tube surrounding an inner body around which run guide means helically arranged in the flow direction. These guide means are arranged in a self-supporting structure around the inner tube and create a helical path for the carrier gas stream and material.

2. Discussion of Prior Art

Apparatus in which the guide means are secured to an inner body are already known. Thus, German 10 66 955 describes an apparatus consisting of an externally heated and cooled flow tube whose interior accommodates a succession of helically arranged and spaced apart guide means in the flow direction. Aerofoil-like curved or flat plates are used as guide means, and are secured to a rod or pipe centrally installed in the flow pipe and distributed over the whole length of the rod or pipe.

Such types of apparatus have proven very suitable in many cases. Compared with other types of apparatus used for heating, cooling or drying finely particulate solids, these types of apparatus operate with relatively small amounts or carrier gas since the heat or cold is transmitted through the heated or cooled wall. For this reason, for example, solvent-moist products can easily be dried under a protective gas. Additionally, the recovery of the solvent is facilitated and the closed construction of the system reliably prevents environmental contamination.

Difficulties arise, however, if aggressive media which attach even corrosion-resistant materials such as stainless steel and Hastalloy are produced during the heating, cooling or drying procedure. In such cases the known types of apparatus cannot be used or, if they are used, they have the drawback of only a short active life.

The afore-mentioned types of apparatus even when enamelled are unsatisfactory since the inner tube provided with the guide means cannot be satisfactorily enamelled.

SUMMARY OF THE INVENTION

It is an object of the invention, therefore, to provide an apparatus for heating or cooling and in particular for dying finely particulate solids which avoids the aforementioned disadvantages and can also be used in conjunction with aggressive media.

This object is achieved by an apparatus for heating or cooling, and in particular for drying finely particulate solids in a carrier gas stream conducted along a helical path, said apparatus comprises an externally heated and cooled flow tube and spaced apart guide means helically arranged in succession in the flow direction between the flow tube and an inner body, which helical guide means comprises aerofoil-like curved or flat plates distributed over the whole length of the said inner body, guide means being a self-supporting construction not secured to the inner body.

The apparatus according to the invention for heating or cooling and in particular for drying finely particulate solids enables excellent heat exchange efficiencies to be achieved with the lowest structural and energy expenditure. The apparatus contains a plurality of guide means which are formed as aerofoil-like curved or flat plates and extend over the whole length of the centrically arranged inner body. Successive plates are displaced with respect to one another and matched in such a way as regards their pitch to the flow velocity of the carrier gas that the leading edges of the plates continue to disperse the solid particle concentrations produced in the carrier gas streams added between two preceding plates. Accordin to the invention, the guide means are not secured to the inner body but are designed as a self-supporting construction surrounding the inner body to form a narrow annular gap.

The separation of the inner body from the guide means enables the inner body as well as the inside of the flow tube to be provided with an enamel coating resistant to aggressive media. The utilizability of the apparatus is thereby substantially increased and extended to areas in which the apparatus could hitherto not be used or could be used only to a limited extent.

Suitable construction materials for the guide means include, depending on the intended use, a wide variety of materials resistant to the given conditions. Suitable materials are e.g. thermoplastic and duroplastic materials. Guide means made of duroplastic materials (phenol resins reinforced with asbestos fibres) have proved particularly suitable.

The apparatus according to the invention has all the advantages of the corresponding types of apparatus in which the inner body and guide means form a single unit. The apparatus according to the invention is characterized by a high degree of effectiveness especially in the field of pneumatic drying, which is due to the fact that the solid particles, even at low axial flow velocity, are hurled with a relatively high velocity and high centrifugal acceleration against the wall and slip along the latter in the form of a thin uniform film. A direct and intensive heat exchange is achieved in this way between the wall and solid, with an almost complete utilization of the heating surface. As a result of the friction of the solid against the wall, a high relative velocity between the latter and the carrier gas is also established. Extraordinarily high heat transfer efficiencies are thereby achieved per unit area of heating surface, with the result that the apparatus of the invention achieves an optimum drying efficiency referred to the heating surface, with an optimum utilization of the heating surface as a result of a thin film-like distribution of the solid particles of the material to be dried on the tube wall and with high thermal transfer coefficients. A decisive advantage of the apparatus when used for drying is also the fact that despite the low heating surface temperature, which prevents damage even in the case of temperature-sensitive materials, relatively high temperatures and degrees of saturation of the waste gas at the outlet from the dryer can be achieved. This means that the apparatus can be operated with very low specific gas amounts or with a high gas loading. As a result, a low specific heat consumption can be achieved, and, moreover, only small amounts of energy have to be expended to circulate the carrier gas through the drying plant. The size of the apparatus and plant costs can be kept correspondingly low.

The plates are conveniently so designed that they do not extend right up to the inner wall of the flow tube.

They have a groove on their outer edge into which a flexible lip is inserted. The object of this lip is to give the annular gap between the inner surface of the outer body (flow tube) and guide body a defined interspacing of between 0.5 and 2 cm.

It is also possible to design the flow tube or the rod or both so that they can be swivelled and set in slow rotation. The rotation should, however, take place so slowly that no gas or material is conveyed. With such a slow rotational movement the energy consumption is negligibly small, as is the maintenance and susceptibility to malfunctioning, compared to a quick rotational movement required for mechanical conveyance.

Depending on the diameter of the helical tube, for example, 4, 6, 8 or more enamelled rods are installed, which are arranged concentrically and at a uniform interspacing around the enamelled inner body. These retaining rods are normally spaced a few millimeters to a few centimeters from the inner body and are supported at their lower end in a carrier ring of the inner body. This carrier ring is formed by a collarshaped bulge in the inner body and is also enamelled. The carrier ring has circular depressions which accommodate the corresponding (end) pins of the enamelled rods. In order to protect the enamel of the accommodation openings in the carrier ring and the enamel of the rod pin, a seal made of a resistant material, e.g. polytetrafluoroethylene, is placed underneath, or a correspondingly shaped collar consisting of the same material as the seal is inserted in the accommodation opening. This prevents the enamel from being damaged and destroyed as a result of friction of the pin in the accommodation opening.

The guide vanes moulded from the duroplastic material (e.g. asbestos embedded in phenyl resin) have a bore at both ends, whose opening roughly corresponds to the diameter and whose interspacing roughly corresponds to the interspacing of the retaining rods.

The guide vanes are stacked on the retaining rods and kept apart from one another by spacers consisting of the same material as the guide vanes. These spacers are tubular members or sleeves whose internal diameter roughly corresponds to the diameter of the retaining rods. They are also stacked on the retaining rods and support the guide vanes that are placed on them.

The guide vanes are assembled in a helical manner starting from the carrier ring, which serves as a foundation for the further assembly of the guide van construction, in such a way that the spacers are of different lengths. An appropriate pitch of the guide vanes and thus at the same time of the material stream is determined, according to requirements, by the difference in length of the spacers (height). Two guide vanes separated by a spacer overlap on each retaining rod, thereby producing a helical arrangement of the guide vanes around the enamelled inner body. The edge of the guide vanes facing the inner body is if necessary carefully adapted by mechanical treatment (grinding or milling) to the enamelled surface of the inner body so that the edge of the guide vanes lies as closely as possible against the surface of the inner body.

The edge of the guide vanes facing the enamelled inside face of the external body has a groove in which, for example, a lip made of polytetrafluoroethylene is inserted and is bonded to the guide vanes. The purpose of the lip is to define accurately the free gap between the guide vanes and external body so as to prevent the formation of any concentrations of material.

The gas stream is normally added tangentially underneath the delivery device of the material being dried, onto the inner body and outer body surfaces. Following the path of the guide vanes, the gas stream meets the material to be dried, which is, for example metered into the helical tube via an endless screw or via a chute device, and is entrained along the guide vane arrangement. The heat required to dry the material is supplied through the free surface of the heated inner body and heated outer body.

It is also possible to guide the material to be dried and the gas in countercurrent.

The construction of the helical tube is not restricted to a vertical arrangement, and an inclined or horizontal arrangement is also possible.

BRIEF DESCRIPTION OF DRAWINGS

The invention is illustrated in the accompanying drawing in which.

DESCRIPTION OF SPECIFIC EMBODIMENT

Figure 1:
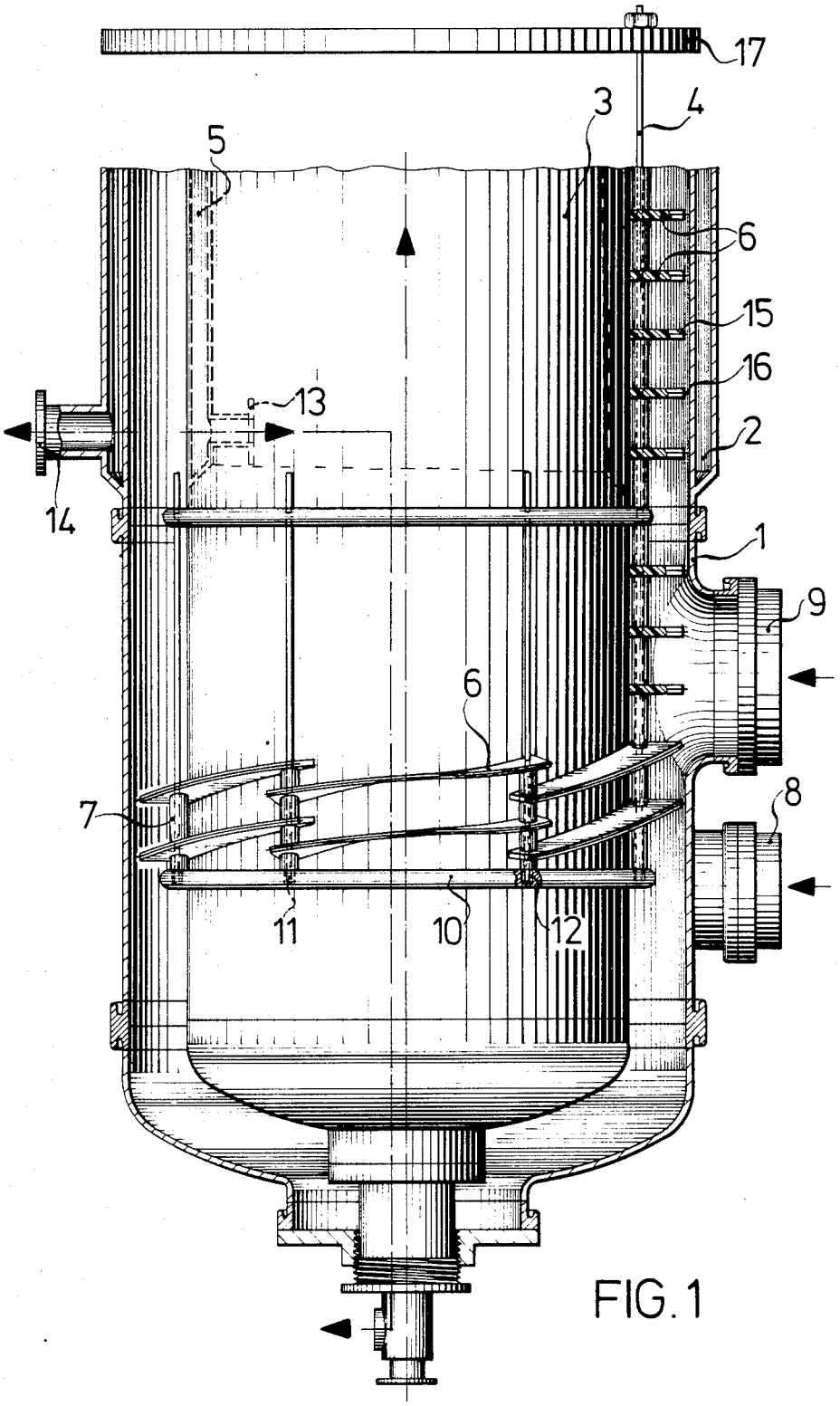
FIG. 1 is a side elevation, partially in section showing an apparatus of the invention.
Figure 2:
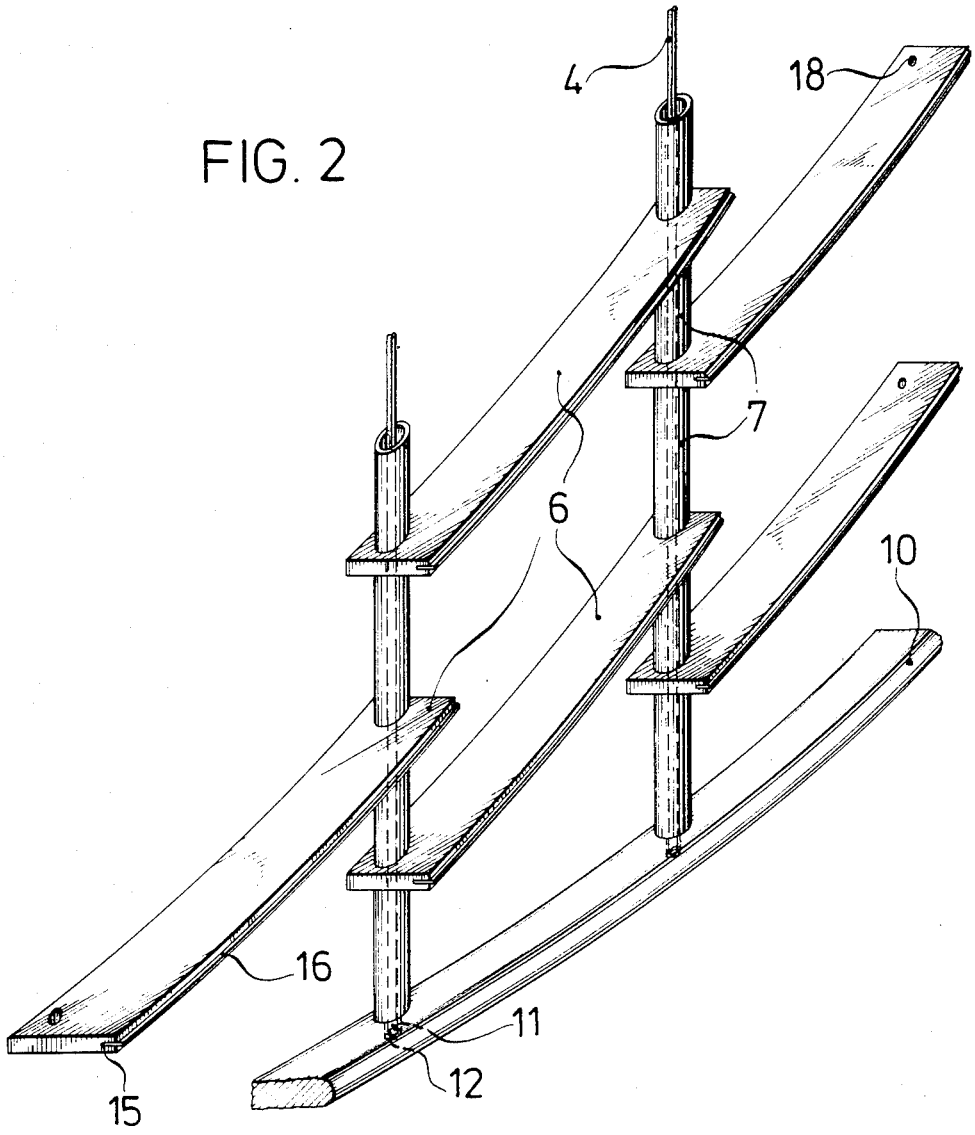
FIG. 2 is an enlarged detail view of the apparatus of FIG. 1.

A suitable embodiment is illustrated in FIGS. 1 and 2. In these Figures, 1 denotes an outer body, 2 a heating jacket, 3 an inner body, 4 a retaining rod, 5 the heating for the inner body, 6 a guide vane, 7 a spacer, 8 a gas inlet, 9 a product inlet, 10 a carrier ring, 11 a retaining rod pin, 12 an accommodation opening in the carrier ring, 13 the steam outlet from the inner body, 14 the steam outlet from the heating jacket of the outer body, 15 a groove in the guide vane, 16 (FIG. 2) a lip inserted into the groove 15, and 17 a cover fastened to the retaining rods 4.

According to another embodiment of the helical tube according to the invention, the guide vanes are arranged as a self-supporting construction around the enamelled inner body. This is achieved by providing both ends of the guide vanes with a foot which takes over the task of the retaining rod and spacers, as exemplified in the preceding structural description. The end of the foot is provided with a pin, while a corresponding groove is provided in the upper face of the guide vanes. This groove serves to accommodate the pins of the foot of the guide vanes arranged thereover. Since the feet of the guide vanes are of different lengths, a helical arrangement is produced around the inner body. Every two adjacent guide vanes are joined to one another by a guide vane arranged above, as can be seen FIG. 4. In this connection, the groove at the end of one of the guide vanes receives the pin of the foot of the guide vane arranged thereabove, and the groove of the adjacent guide vane receives the pin at the other end of the guide vane arranged thereabove. The connection between the pin and groove is produced by bonding with the same material from which the guide vanes were made.

The guide vane construction rests at the lower end of the tube on an enamelled carrier ring. This carrier ring is formed by a collar-shaped bulge on the inner body.

A suitable pitch of the guide vane and thus at the same time of the material stream is determined, according to requirements, by the difference in length of the feet of this guide vane.

Since the pin of the foot and the groove on the upper edge of each guide vane are directly opposite one another, two guide vanes in each case overlap at the position of the pin and the position of the groove. The edge of the guide vanes facing the inner body is, if necessary, carefully adapted by mechanical treatment (grinding or milling) to the enamelled surface of the inner body so that the edge of the guide van lies as close as possible against the surface of the said inner body.

The edge of the guide vanes opposite the enamelled inner surface of the outer body likewise have a groove as described in FIGS. 1 and 2, into which, for example, a polytetrafluoroethylene lip is inserted and bonded to the guide vane. The purpose of this lip is as previously discussed.

The remaining features of the construction are essentially as shown in FIG. 1.

Figure 3:
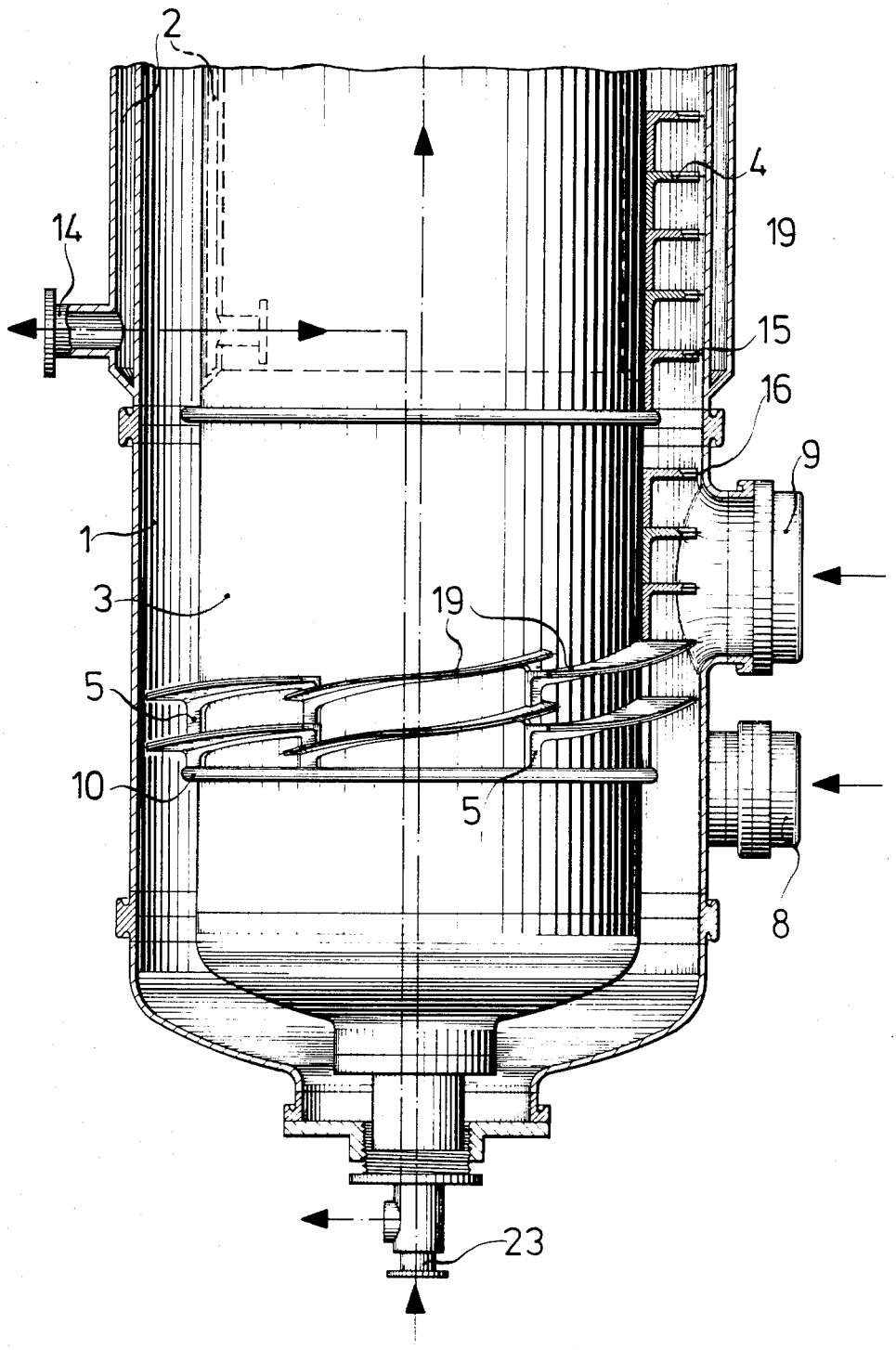
FIG. 3 is a view similar to FIG. 1 showing another feature of the invention.
Figure 4:
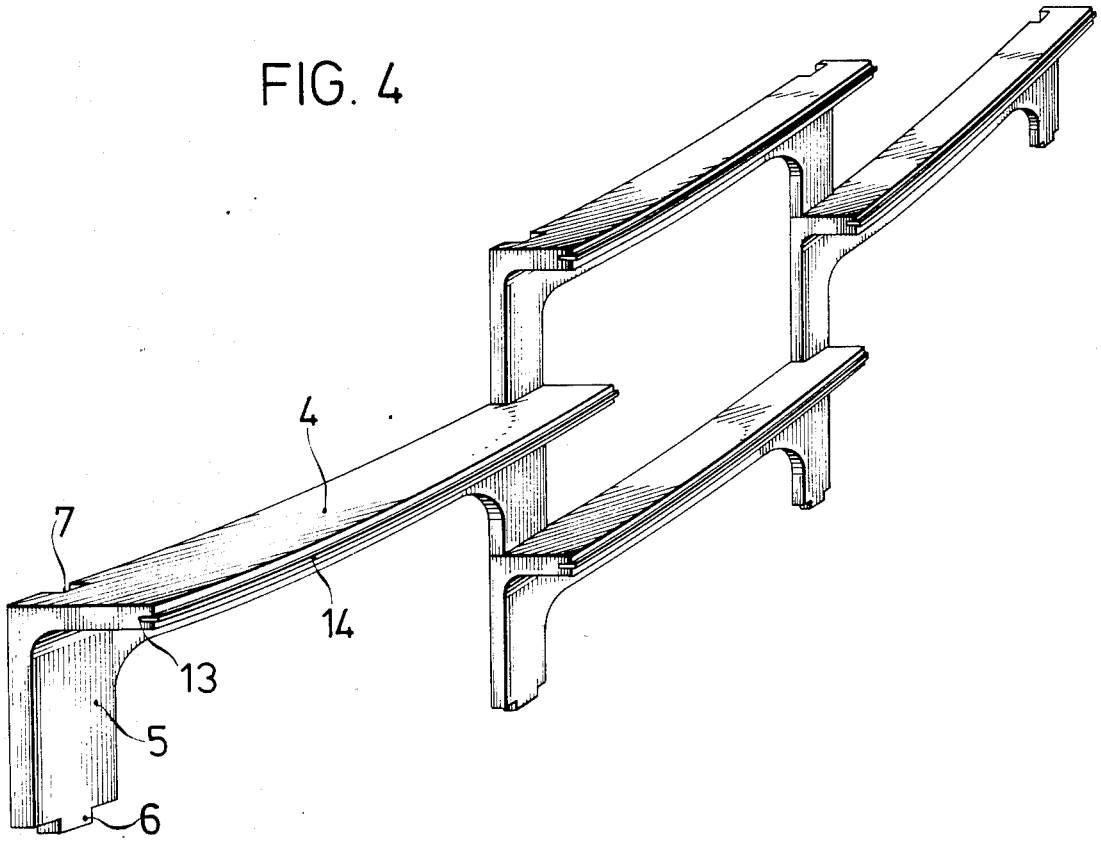
FIG. 4 is an enlarged detail view of the apparatus shown in FIG. 3.

The just-described arrangement of the guide vanes around the inner body is illustrated in FIGS. 3 and 4. In these Figures, 1 denotes an outer body, 2 a heating jacket, 3 an inner body, 4 a guide vane, 5 a gas inlet, 9 a product inlet, 10 a carrier ring, 11 a steam inlet for heating the inner body, 12 a steam outlet from the heating jacket of the outer body, 13 (FIG. 4) a groove in the outer edge of the guide vane, and 14 (FIG. 4) a lip inserted into the groove 13.

What is claimed is:

1. In an apparatus for heating or cooling and in particular for drying finely particulate solids in a carrier gas stream conducted in a flow direction along a helical path, said apparatus comprising an externally heated and cooled flow tube concentrically surrounding a heated or cooled inner body, and guide means helically arranged in succession in said flow direction and disposed between said flow tube and said inner body and comprising aerofoil-like curved or flat plates distributed over the entire length of said inner body, the improvement wherein said guide means are a self-supporting structure not secured to said inner body, the guide means construction rests at the lower end of the tube on an enameled carrier ring, the carrier ring is formed by a collar shaped bulge on the inner body, the inside of the flow tube and the inner body are provided with an enamel coating resistant to aggressive media and the guide means comprise a thermal plastic or duro plastic material.

2. An apparatus according to claim 1, wherein the successive plates are displaced with respect to one another.

3. An apparatus according to claim 1, wherein the guide means comprise a phenolic resin reinforced with asbestos fibers.

4. An apparatus according to claim 1, wherein the edge of the guide means opposite to the enamel inner surface of the outer body has a groove.

5. An apparatus according to claim 4, wherein a lift is inserted in said groove in the edge of said guide means.

* * * * *